US005553463A

United States Patent [19]

Pointer

[11] Patent Number: 5,553,463

[45] **Date of Patent: *Sep. 10, 1996**

[54] EFFICIENCY DIRECTED EVAPORATIVE TYPE SUPPLEMENT CONDENSING SYSTEM FOR HIGH AMBIENT REFRIGERATION OPERATION

[76] Inventor: Ronald J. Pointer, 430 Glen Canyon, Garland, Tex. 75040

[ * ] Notice: The term of this patent shall not extend beyond the expiration date of Pat. No. 5,297,397.

[21] Appl. No.: 219,513

[22] Filed: Mar. 29, 1994

Related U.S. Application Data

[63] Continuation-in-part of Ser. No. 11,002, Jan. 29, 1993, Pat. No. 5,297,397.

[51] Int. Cl.[6] ..... F25B 27/02

[52] U.S. Cl. ..... 62/238.6; 62/399; 62/305

[58] Field of Search ..... 62/238.6, 238.7, 62/305, 430, 399

[56] References Cited

U.S. PATENT DOCUMENTS

| | | | |
|---|---|---|---|
| 3,908,393 | 9/1975 | Eubank | 62/305 |
| 4,199,955 | 4/1980 | Jonsson | 62/79 |
| 4,204,409 | 5/1980 | Satama | 62/271 |
| 4,365,483 | 12/1982 | Binger | 62/183 |
| 4,373,346 | 2/1983 | Hebert et al. | 62/79 |
| 4,918,943 | 4/1990 | Taylor | 62/95 |
| 5,297,397 | 3/1994 | Pointer | 62/278.6 |

*Primary Examiner*—Henry A. Bennett
*Assistant Examiner*—William C. Doerrler
*Attorney, Agent, or Firm*—T. D. Copeland; D. W. Quimby

[57] ABSTRACT

The insertion of a specifically designed evaporative cooled supplemental condenser in a refrigeration system, working in operative relation with the air cooled condenser of the system, enhances the system operation. The objective of this evaporative type supplemental condenser is to improve the condensing capacity of the existing air cooled refrigerant condenser to the extent that its performance will counteract the detrimental effects of high ambient temperatures by supplementing the existing condenser capacity. The system's air cooled condenser will perform as the primary condenser and the supplemental condenser will correct the pressures and temperatures of the refrigerant as required, for counteracting the effects of high ambient temperature operation on air conditioning refrigeration systems.

8 Claims, 7 Drawing Sheets

EFFICIENCY DIRECTED EVAPORATIVE TYPE SUPPLEMENT CONDENSING SYSTEM FOR HIGH AMBIENT REFRIGERATION OPERATION

This is a Continuation-In-Part (CIP) Application to my patent application Ser. No. 08/011,002, filed Jan. 29, 1993, which was issued on Mar. 29, 1994, as U.S. Pat. No. 5,297,397, and was entitled "Efficiency Directed Supplemental Condensing System for High Ambient Refrigeration Operation". The contents of that patent are incorporated herein by reference.

The patented system filled an important need in increasing the efficiency and reducing the power required (and consequently the cost) of refrigeration systems operating in high ambient temperatures, i.e., Ninety degrees Fahrenheit or higher. The present invention further expands on the patented system, by combining the best features of the patented supplemental condensing system, and the convential drip type evaporator cooling tower, however, in this instance, the fluid, circulating over the drip louvers of the cooling tower, is the coolant discharge leaving the supplemental condenser. This coolant may be water, or a ten percent Glycol and water solution, or any non-corrosive fluid combination.

Applicant's prior method/system is now known as the "C.A.T." system, which is the acronym for "Condensing Assist Technology". since it increased efficiency and reduced power requirement (cost) by assisting in the improved performance of conventional air cooled condensing air conditioning and refrigeration systems. This present invention further improves the performance and lowers the cost of all systems, including the C.A.T.

This invention relates to refrigeration-type systems, one example of which is commercial entity air conditioning system, wherein air cooled, roof top mounted, equipment is used.

Refrigeration systems having an evaporating heat exchanger in which liquid refrigerants are evaporated to draw heat from another medium, such as air or water are well known in this art. A compressor normally serves to circulate the refrigerant and has a low pressure or suction side, which receives spent refrigerant from an evaporating heat exchanger, and a high pressure side which discharges hot compressed refrigerant vapor into a high pressure, high temperature line. The compressed refrigerant vapor is commonly received by an air cooled condensing heat exchanger transferring heat from the compressed refrigerant to another medium, such as air or water. The cooled and condensed refrigerant is then transferred through a high pressure liquid line to an expansion device, which discharges refrigerant through a narrow orifice into an evaporating heat exchanger, wherein expansion, evaporation and heat absorption takes place which produces the cooling effect.

Numerous patents have issued that disclose various locations of heat exchangers within a refrigeration system to improve performance in different ways, but none to my knowledge has as its object or as its result, that the system efficiency remains the same on extremely hot days (110° F. to 130° F.), as it is on moderate climate days. This system is unique in its neutralizing effect of high ambient operation.

Many prior art patents, such as U.S. Pat. No. 4,773,234, to Douglas C. Kann, issued Sep. 27, 1988, entitled "Power Saving Refrigeration System", and U.S. Pat. No. 4,683,726, to Edward J Barron, issued Aug. 4, 1987, entitled "Refrigeration Apparatus", proffer to provide improved efficiency and economy of operation, by employing a spray type of heat exchanger, identified as a "sub-cooler", and located at various points in the refrigeration cycle other than directly between the compressor and the condenser, as in the "after-market supplemental precondenser" of the Applicant's invention, which does not employ a spray device of any type, and which does specifically position his principal functioning device between the compressor and the condenser, and which "in combination" with an air cooled condenser. FIG. 5 of U.S. Pat. No. 4,365,483, issued Dec. 28, 1982, to Larry W. Binger, for "Vertical Convection Heat Dissipation Tower", discloses a tower similar in construction to Applicant's tank 120; however, the purpose of his invention, its location in the system, and result acheived, are all entirely different from those of the Applicant. For example, Binger's purpose is to sub-cool, not condense; his location is downstream from the main condenser, so he cannot "precondense" the refrigerant vapor, which will have already been condensed when it arrives at the cooling tower.

U.S. Pat. No. 3,926,008, issued Dec. 16, 1975, to Robert C. Webber, for "Building Cooling and Pool Heating System", shows a system using two separate condensing methods and structures incorporated into an air conditioning system. Only one of these two condensing techniques can be used at a time, and isolation valves are required to separate the two.

The Jonsson U.S. Pat. No. 4,089,667, issued May 16, 1978, for "Heat Extraction or Reclamation Apparatus for Refrigerating and Air Conditioning Systems" shows a water cooled heat exchanger located upstream from the air cooled condenser designed for the purpose of removing heat from the superheated refrigerant gas to heat water. This patent states the concern of allowing an after market water cooled condenser to condense the refrigerant in excess that it would impose added work for the compressor to circulate the condensed liquid refrigerant through a larger path in the refrigerant circuit. There is no disclosure in this or any other known patent for a system specifically designed for, or functioning as a means for neutralizing the effects of extremely hot days, i.e., on the order of 90°–130° F., as is customary in the Southwestern part of the United States in the summer months, with roof mounted air cooled condensing equipment.

The Applicant's system may be used with many different refrigerants, typically R22 and R202, which have generally replaced R12, due to the latter's harmful effects on the environment. Other non-harmful refrigerants may also be used in the instant invention.

SUMMARY OF THE INVENTION

One of the principal reasons for this invention, was the need that was recognized by the Applicant, that arose from his observation of air conditioning systems functioning in the Southwestern part of the United States during the extremely hot summer months (known locally as "dog-days"). Systems that functioned very well under moderate weather conditions, would not provide the necessary cooling during days when the outside air temperature rose above 95 degrees Fahrenheit (95° F.). Not only did the heat removal of the air conditioning system decrease, but the cost of operation increased.

Prior objectives of installing a heat exchanger upstream from the air cooled condenser have been to recover waste heat and make this recovery usable to heat water. Prior art has not disclosed an accessory that whose objective was to neutralize the effect of high operating temperatures on air cooled condensing equipment. Unlike the heat exchanger or desuperheaters that do offer efficiency improvement when water flow is passing through the heat exchanger, when no flow is offered, no efficiency improvement is offered. No prior art has cited an accessory that has the objectives of this evaporative supplemental condenser accessory.

However, with the addition of the evaporative supplemental condenser as an accessory to existing air conditioning systems, both the heat removal (a measure of coolness and comfort) and the consumption (a measure of cost), returned to an acceptable range of performance. The total "efficiency" reflects both of these features.

The combined efficiency decrease of air cooled condensing refrigeration systems showed an approximately 10% combined efficiency loss for each 10° F. rise in operating ambient conditions above 90° F. It has been identified that the operating conditions of equipment located on rooftops of buildings located in the Southwestern portions of the United States exceed 130° F. At these 130° F. ambient temperatures, the combined efficiency decrease(capacity decrease plus power requirement increase) exceeded 50%. Therefore, the principal objective of this invention is to neutralize the effects of high operating temperatures on air cooled refrigeration equipment operating in these extreme high temperature conditions.

DESCRIPTION OF THE PREFERRED EMBODIMENT(S)

Figure 1:
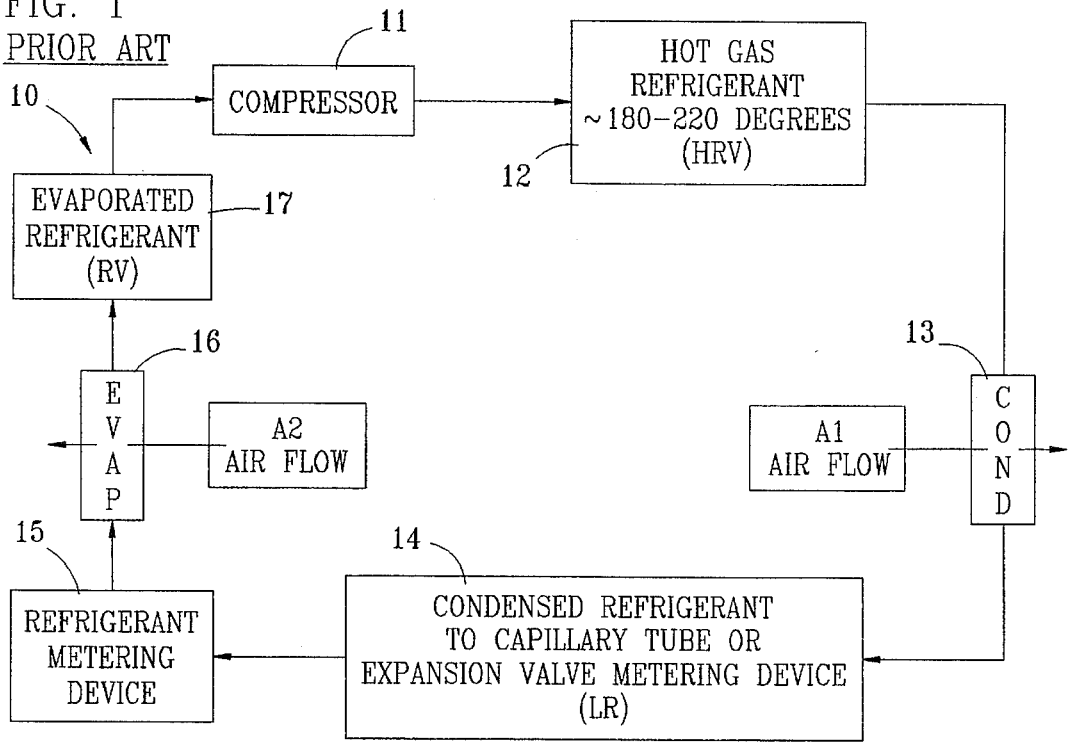
FIG. 1 PRIOR ART
FIG. 1 is a generalized schematic diagram of refrigeration systems of the prior art.

Referring now to FIG. 1, it will be seen that conventional refrigeration systems (air conditioning in particular), identified at 10, includes a compressor 11 that delivers hot compressed refrigerant vapor HRV to output line 12, which delivers such vapor to condenser 13, wherein the vapor is exposed to a cooling air flow A1, and therein condenses to its liquid state (one form being R-22). The now liquid refrigerant LR at reduced temperature flows through line 14 to metering device 15, which converts the liquid to a vapor again, inside evaporator 16, which absorbs heat in the process from inside the house air flow A2. From the evaporator 16, the now heated refrigerant vapor RV travels through line 17 to the input side of the compressor, wherein it is compressed (which also heats the vapor), and re-enters the refrigeration cycle via line 12 as high pressure hot refrigerant vapor HRV.

Figure 1A:
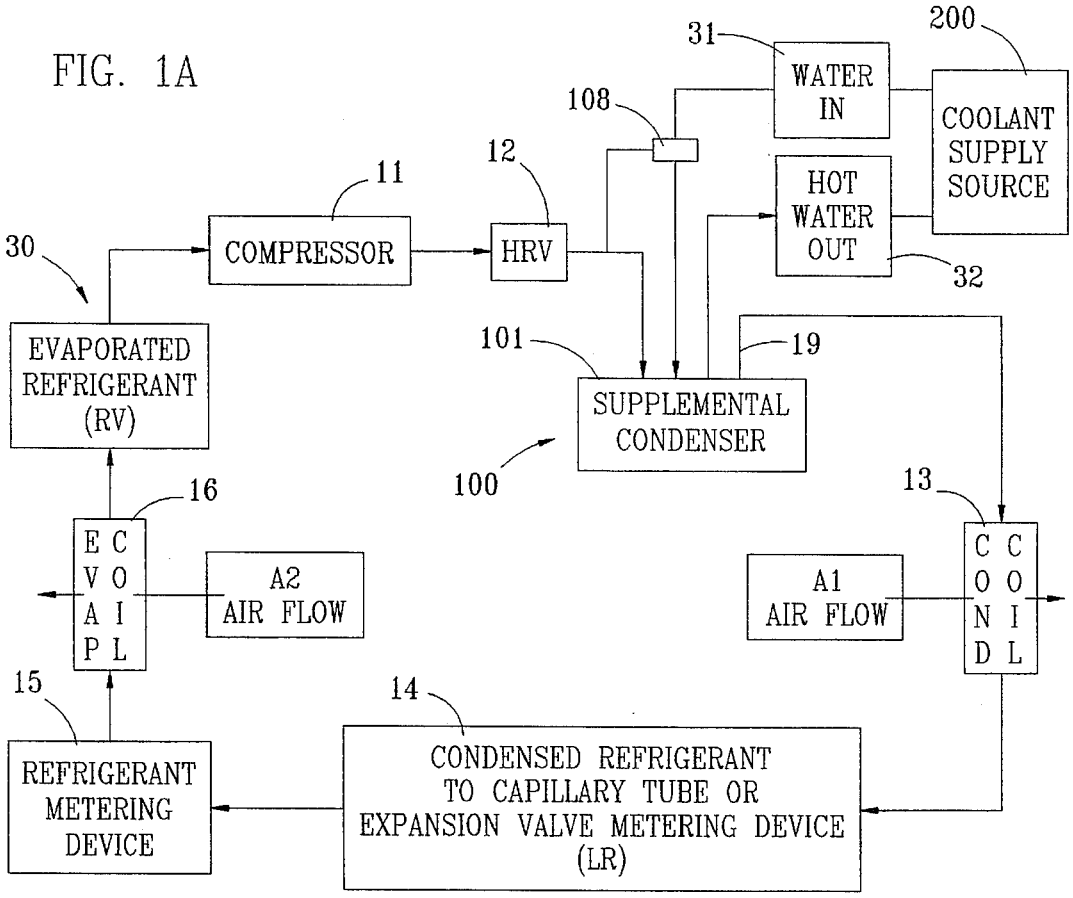
FIG. 1A is a view similar to that of FIG. 1, wherein the system has been converted into the instant invention, by the addition of the Applicant's Evaporative Supplemental Condenser (ESC), identified as "Coolant Supply Source" on line between the output of the compressor and the inlet of the supplemental condenser.
Figure 3:
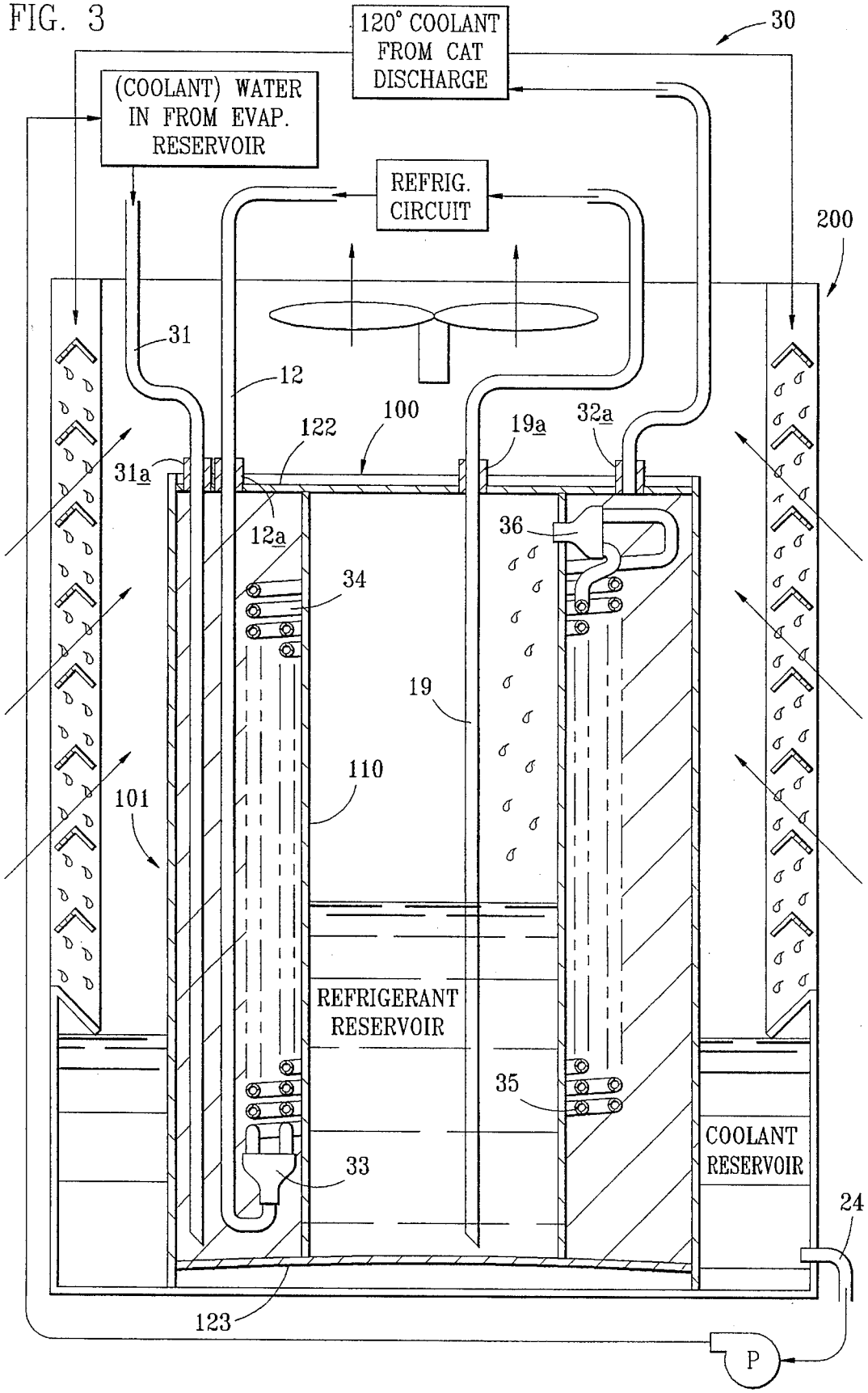
FIG. 3 is a cut-away view of the construction of the evaporative-type supplemental condenser of the present invention, which is an integrated combination of an evaporative cooling tower and the C.A.T.
Figure 4:
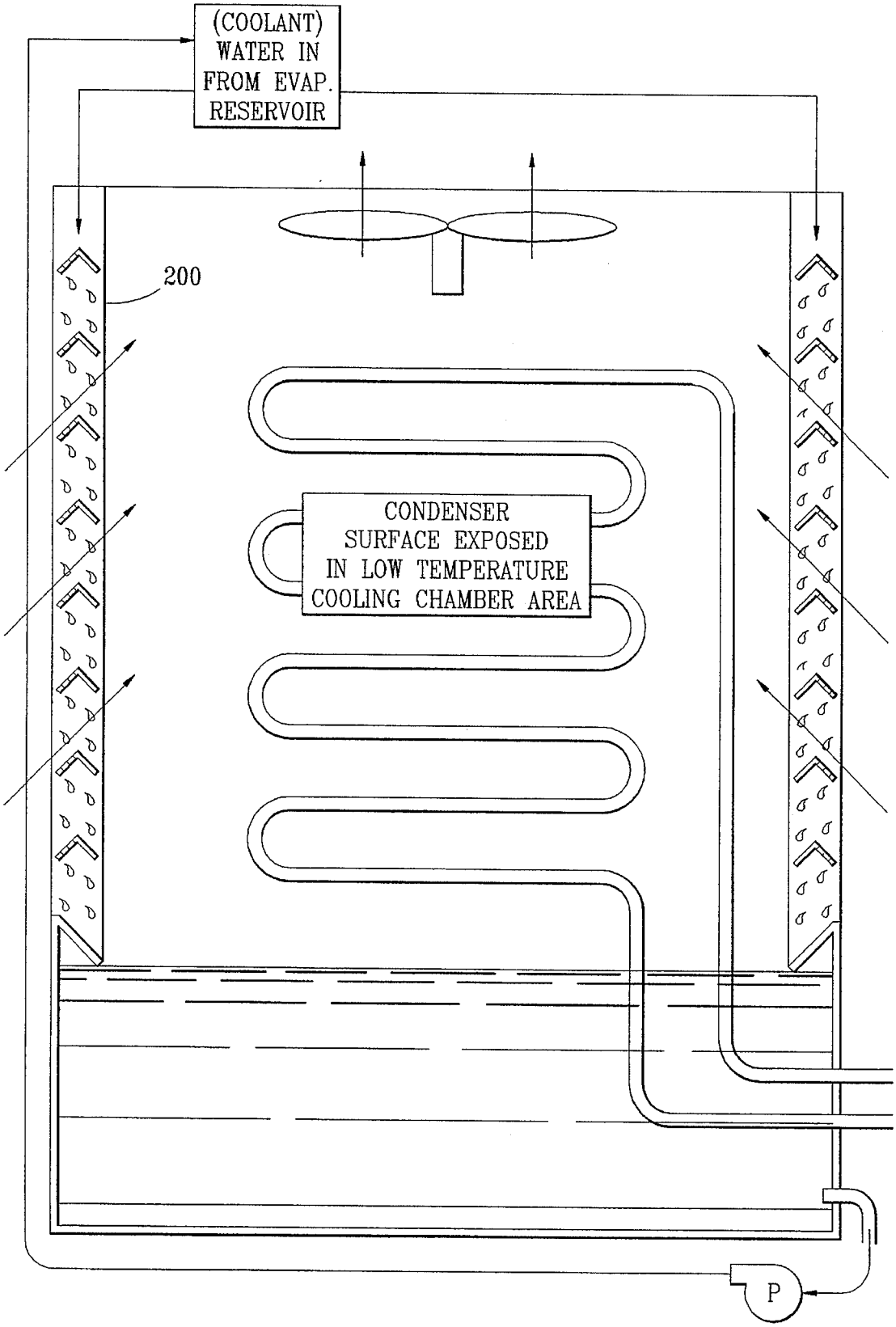
FIG. 4 PRIOR ART
FIG. 4 is a schematic view of a prior art evaporative condensing cooling tower.
Figure 5:
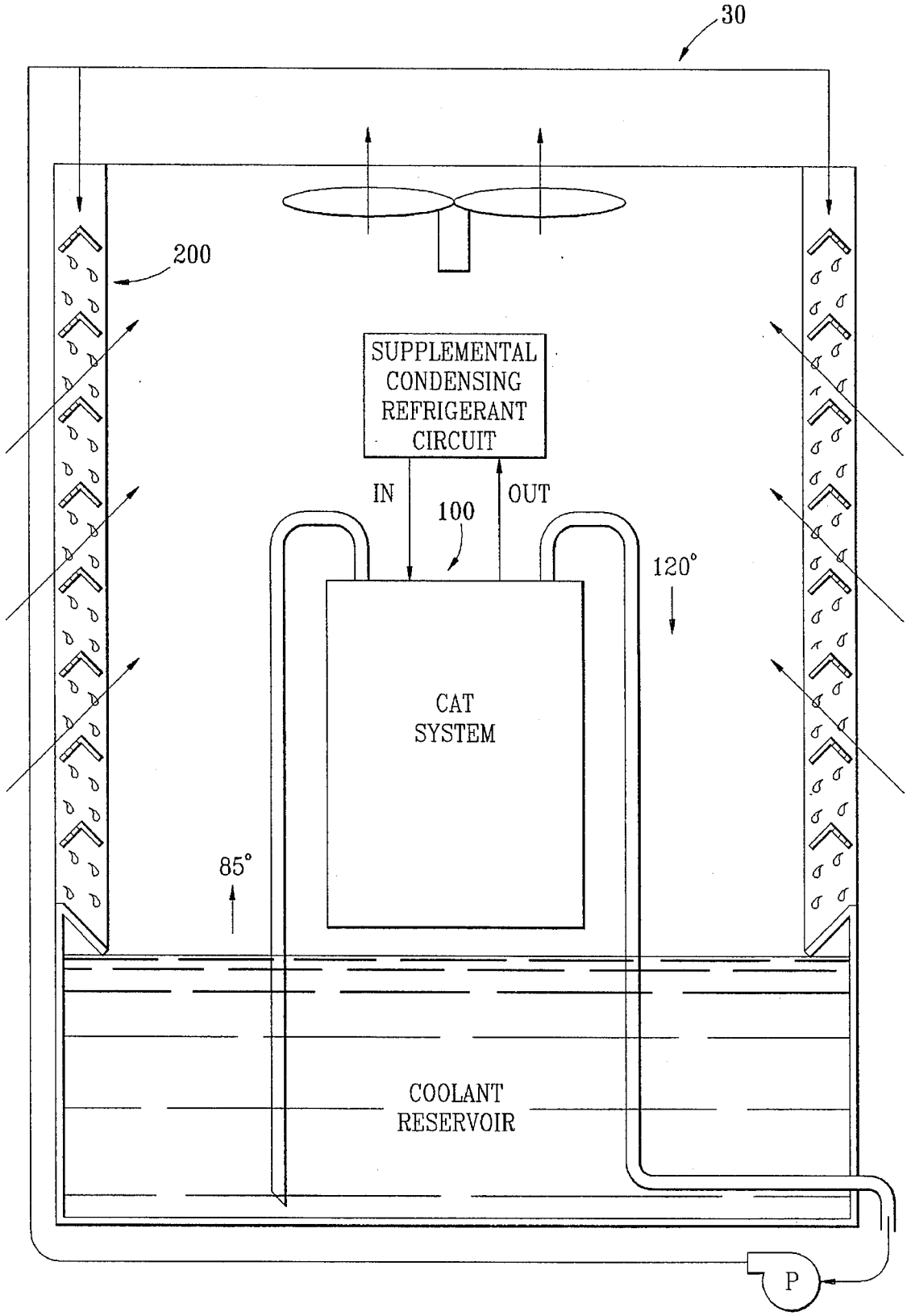
FIG. 5 is a schematic of a conventional evaporative cooling tower in combination with an integrally installed C.A.T. system.
Figure 6:
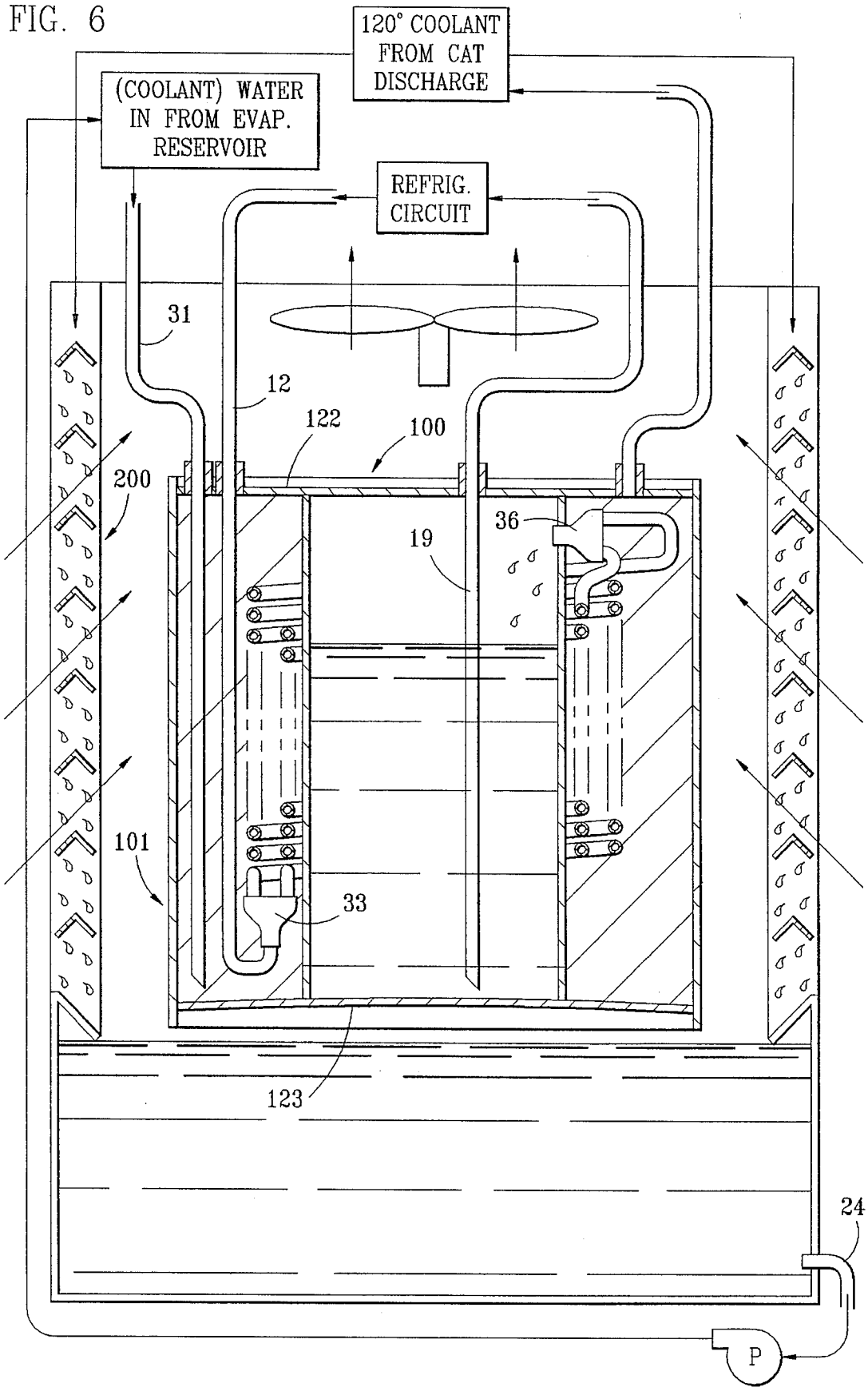
FIG. 6 is an operative combination of the evaporative cooling tower and the integrally installed C.A.T.
Figure 6A:
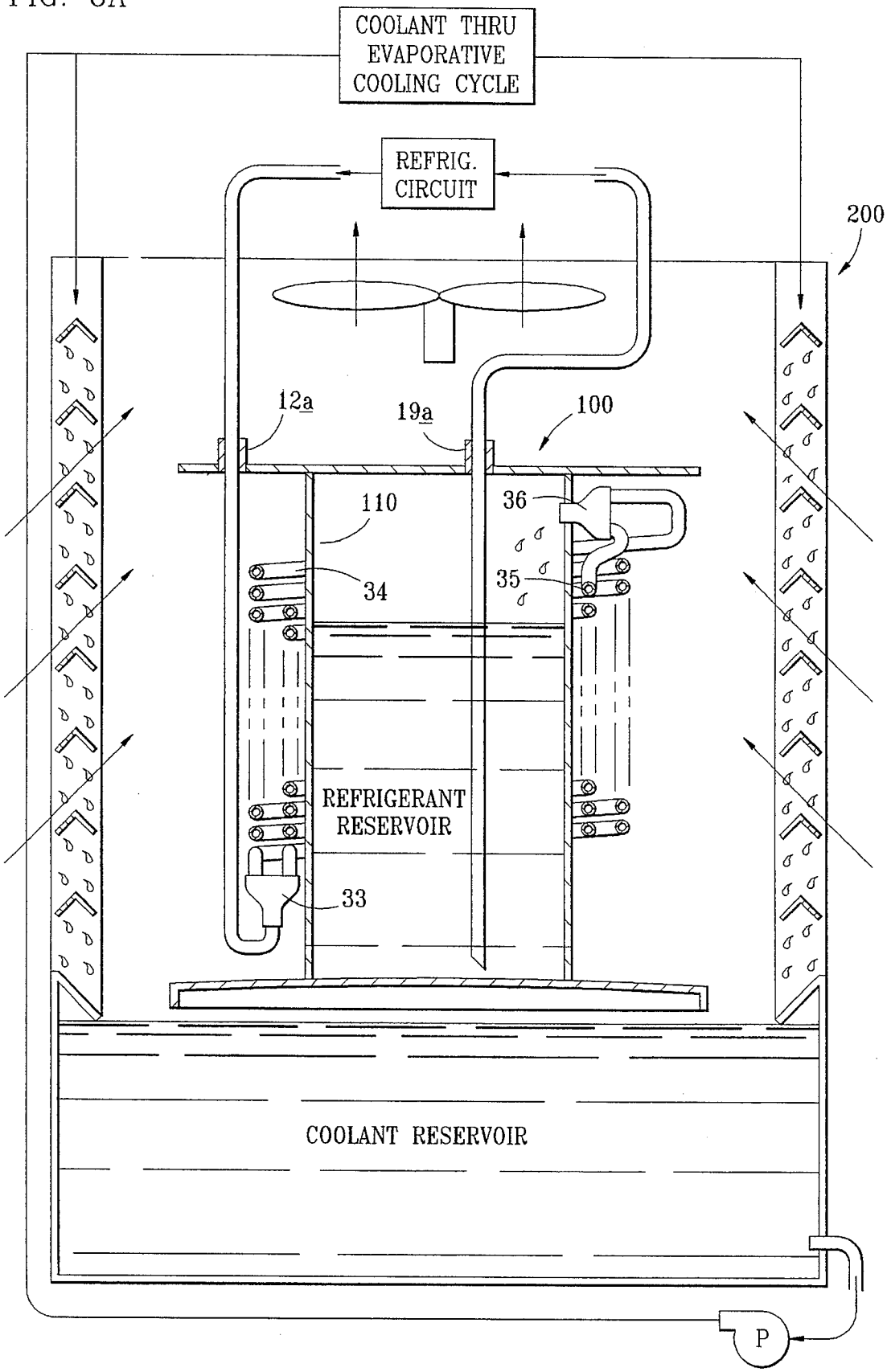
FIG. 6A is a combination, wherein the outer cover of the C.A.T. has been removed to change the cooling medium of refrigerant coils from liquid to evaporative cooled vapor by being exposed to the low temperatures of the evaporator chamber.

Turning now to FIG. 1A, it will be seen that the schematic diagram of the improved system 30 of this invention, utilizes the same basic system as that shown in FIG. 1, with the exception of the addition of the supplemental condenser unit 100 and the evaporative condensing cooling tower 200, which units may be integrated into a single structural and performing unity as seen in FIGS. 3, 5 and 6. Unit 100 comprises a cylinder shell tank 101 into which hot refrigerant vapor HRV line 12 enters, and from which refrigerant vapor line 19 containing precondensed refrigerant vapor exits from the tank 101 on its way to condenser 13. The supplemental condenser accessory unit 100 is also identified by its acronym of C.A.T., and it is adapted to be inserted into existing refrigeration type systems as an "after market" replacement unit, by inserting into an existing system, as in FIG. 1, for example, between the hot gas refrigerant line 12, and the line (now 19) which replaces line 12 that formerly entered the system condenser 13.

Prior to entering the tank 101, the coolant water line 31 must enter and be monitored by compressor discharge pressure operated water valve 108 of unit 100 to maintain the desired coolant volume, and hence affect the flow and temperature of the coolant water circulating through the unit 100. As the outside air ambient temperature rises, the pressure in the inlet vapor line 12 will increase, thereby opening the pressure operated water valve 108, to increase the flow of coolant water through the "C.A.T." unit 100 when the ambient temperature increases. This water valve 108 corresponds to valve marketed by Penn-Johnson as their series V-46, or its equivalent.

With this improvement the treatment of the heated coolant (approx. 120 degrees F.) leaving via line 32 will enter into the ECS of FIG. 5 and be evaporatively cooled down to near the, Wet Bulb Temperature, and this coolant will be made available for re use and re-entry into the coolant entry line 31 in the C.A.T. unit 100. The incorporation of the evaporative type cooler to treat the heated discharge coolant flow could be either remote from the C.A.T. system or incorporated into the single package unit as shown in FIG. 5.

Figure 2:
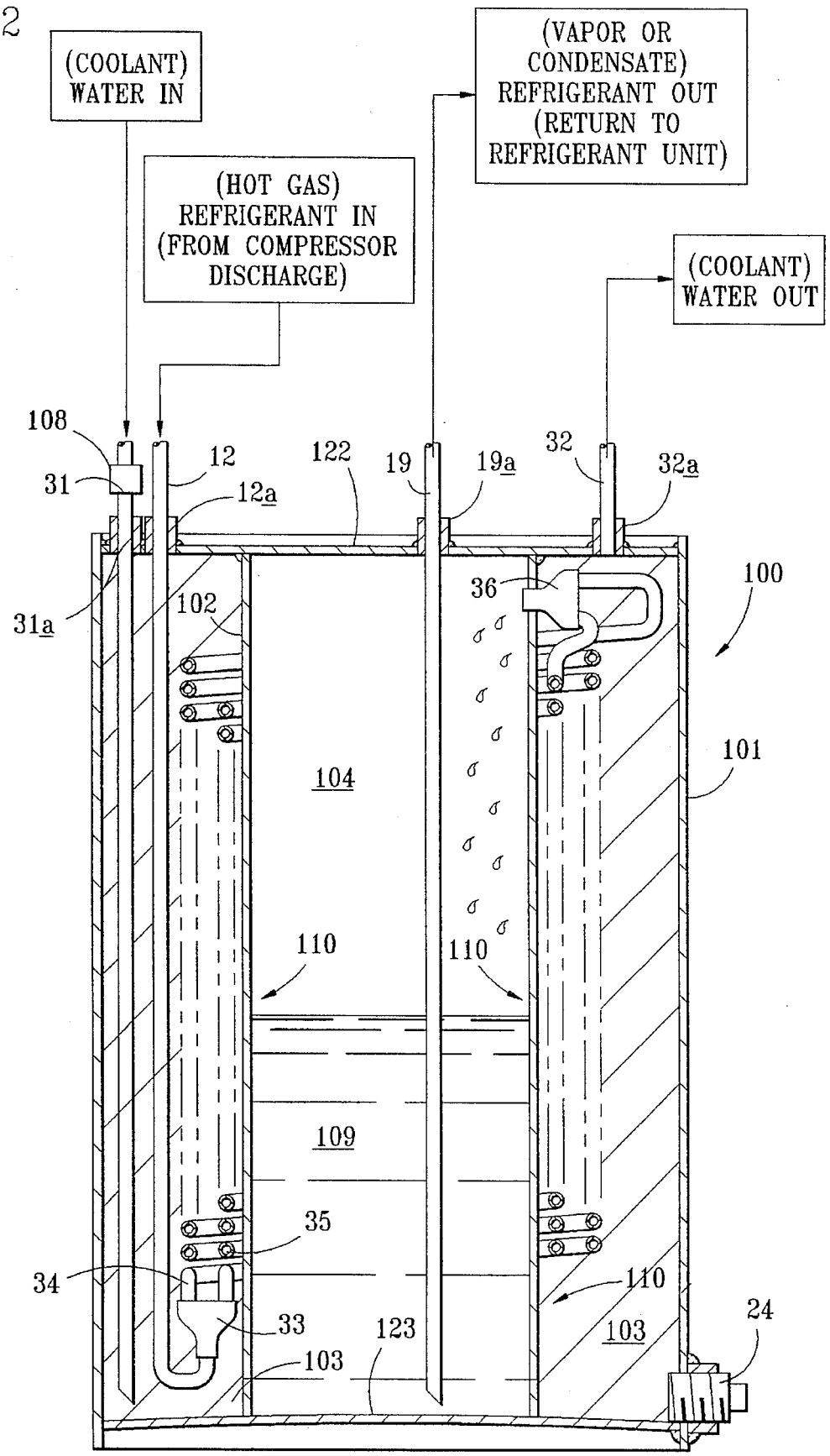
FIG. 2 is a cross-sectional view of the C.A.T. system of the invention of the parent application, of which this application is a Continuation-In Part, wherein the refrigerant lines leading to the supplemental condensing chamber are liquid cooled by a jacket surrounding the refrigerant coils.

A preferred embodiment of the supplemental condenser accessory unit 100, shown in FIG. 2, comprises a cylindrical outer shell 101 of stainless steel material, with a completely hermetically sealed top and bottom covers 122 and 123 respectively. Bottom cover 123 forms a complete seal with shell 101, with no openings; whereas, top cover 122 includes four openings, all sealed by compression or equivalent fittings 12*a* and 19*a* for refrigerant in and out lines 12 and 19, and two more, 31*a* and 32*a* for water coolant in and out lines 31 and 32. Standard drain plug 24 is located at the lower side of shell 101. Pressure operated water valve 108 intercepts coolant water line 31 near its entrance into tank 101 for the purposes hereinbefore described.

In order to obtain an optimum capacity for heat transfer, the refrigerant line passing into tank 101 does so as a single line 12, but within the tank, line 12 is split at Y-fitting 33 into two similar coils 34 and 35, one within the other, and each coil travels a very substantial distance within the tank 101, by being in the configuration of two closely spaced coils that travel in effect "parallel paths" from the entrance Y-fitting 33 to the exit Y-fitting 36, before exhausting into the centrally located refrigerant reservoir 110, usually as a mixture of vapor, which accumulates in vapor reservoir 104, and as condensate, which accumulates in the liquid refrigerant reservoir 109. The water coolant line 31 enters the tank 101 at inlet fitting 31*a*, and goes nearly to the bottom of the tank, whereas heated water in line 32 leaves tank 101 from its fitting 32*a* and then exits through top cover 122 Although this water supply is referred to as a "coolant", that designation holds good only for the incoming water supply, since the water flow will pick up heat in travelling through the very long circuituous path through tank 101.

The employment of a "coil within a coil" as seen within the tank 101 contributes to the tremendous volume of heating that can be accomplished by the structure of the relatively small size tank 101. Also the inclusion of a "tank within a tank" for the accumulation of both liquid and vapor refrigerant is also a substantial contributing factor to the overall operation of this invention.

Even though the heating of the coolant water may be substantial, its use for supplemental heating is secondary to the principal purpose of this system, which is to increase the heat removal from the conditioned air or refrigerated medium, and to lower the utility cost of the refrigeration activities during the months when the outside temperature exceeds 90° F. The combination of these two benefits determines the overall or total efficiency of the system employing a "C.A.T." device, and the combination of the C.A.T. and the evaporative condensing tower further enhances the performance and economy of air conditioning The C.A.T. system condensing capacity is directly controlled by coolant flow. 0 to 100% coolant flow is controlled by a pressure operated water valve, such as the referenced Penn Johnson Series V 46 water valve. The head pressure in line 12 increases as ambient temperature increases. This pressure sensitive water valve reacts to increased pressure by inducing additional coolant into the tank 101 of unit 100. The pressures are reduced at the discharge of the compressor reacting to the coolant flow. As pressures are reduced the coolant flow is also reduced by the pressure controlled water valve.

The foregoing description and disclosure are representative of the concept of this invention, which may be practiced in many ways without departing from the scope and spirit of this invention as reflected in the appended claims.

What is claimed is:

1. A refrigeration system comprising a compressor, a primary air cooled condenser, an evaporator, and an evaporative supplemental support condensing cooling tower, comprising in combination therewith:

a. integrated supplemental condensing means in operative relation with said primary condenser for causing both the efficiency trend of said system to increase and the power demand trend of said system to decrease, as the ambient temperature increases above about ninety degrees Fahrenheit, and b. wherein said condensing means comprises a supplemental condensing system having a first tank and a second tank adjacent thereto and sealed therefrom, c. said second tank being a reservoir for containing varying levels of vapor and liquid refrigerant, d. an incoming and exiting coolant line to said first tank, e. means for receiving incoming hot refrigerant gas from said compressor, and for exiting cooler refrigerant gas and accumulated vapor condensate into said second tank, f. concentric line coils surrounding said second tank, and ultimately delivering said refrigerant into said second tank, g. an exit line from said second tank to deliver partially cooled and partially condensed refrigerant to said primary condenser, wherein h. said partially condensed refrigerant at this point being either a vapor, a condensate or both, when entering said primary condenser, i. and wherein the operating characteristics of said system are such as to counteract the detrimental effect of said ambient temperature increases, j. said integrated supplemental condensing means comprising a first supplemental condenser physically located within the structure of said cooling tower.

2. A condensing assisted technology unit for counteracting the detrimental effect of reduced performance and increased power demand on air conditioning systems on days when the ambient temperature exceeds about ninety degrees, comprising integration of a supplemental condensing system in combination with an evaporative cooling tower, wherein said detrimental effects are further counteracted by this integrated combination.

3. A method for counteracting the detrimental effect of ambient temperature increase in a refrigeration system employing an air cooled primary condenser, comprising in combination, the steps of:

a. inserting a liquid cooled supplemental support condensing system in operative relation with said primary air cooled condenser and physically located within the confines of an evaporative cooling tower, b. directing liquid coolant into a coolant container, c. directing hot refrigerant from the refrigeration system compressor through the coolant and into a refrigerant reservoir, d. directing the now cooled refrigerant ultimately from the refrigerant reservoir back to the inlet side of the compressor for recycling through the refrigeration system, after passing through an evaporative cooling tower for partial evaporation and cooling.

4. A refrigeration system comprising in combination: a compressor, a primary condenser, a refrigerant metering device, an evaporator, a supplemental condenser, and an evaporative cooling tower for reducing temperature of coolant entering said supplemental condenser, and wherein said evaporative cooling tower surrounds and internally contains said supplemental condenser to eliminate the need for additional connections present when a conventional remotely located cooling tower is utilized.

5. A refrigeration system as in claim 4 including a compressor, a primary air cooled condenser, a first evaporator, a supplemental condenser, and a second evaporator in the form of an evaporative cooling tower to assist said supplemental condenser by recycling and reducing the temperature of coolant discharge from said supplemental condenser, and thus put into use and avoid waste of surplus and environmentally valuable water.

6. A refrigeration system, comprising the combination of a Condensing Assist Technology system, known by its acronym CAT, and an evaporative cooling tower, wherein said CAT comprises an outer and inner tank with coolant in the outer tank and refrigerant delivery coils located in said outer tank and exiting into said inner tank, and coolant in and passing through said outer tank and absorbing heat from refrigerant in said coils and said inner tank, and exiting from said outer tank and into the top of said cooling tower for evaporative cooling whereafter said coolant is recycled through said outer tank.

7. A refrigerant system, comprising the combination of a Condensing Assist Technology system, known by its acronym CAT, and an Evaporative Support System, known by its acronym ESS, wherein said CAT comprises an outer and inner tank with coolant in and passing through said outer tank and absorbing heat from refrigerant in said coils and said inner tank, and exiting from said outer tank and into the top of said ESS for evaporative cooling whereafter said coolant is recycled through said outer tank

8. A refrigerant system, comprising the combination of a compressor, a primary condenser, a first evaporator, a supplemental condenser, and a second evaporator in the form of an evaporative cooling tower to assist said supplemental condenser by recycling and reducing the temperature of coolant discharge from said supplemental condenser, and wherein said supplemental condenser comprises a single refrigerant tank surrounded by refrigerant circulating coils which discharge into said tank, and wherein said tank and coils are further surrounded by said evaporative cooling tower to comprise one integrated supplemental condensing system and evaporative cooling tower combination.

* * * * *